US006678970B2

(12) United States Patent
Liu

(10) Patent No.: US 6,678,970 B2
(45) Date of Patent: Jan. 20, 2004

(54) WELTED SHOE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 132 days.

(21) Appl. No.: 10/117,659

(22) Filed: Apr. 5, 2002

(65) Prior Publication Data

US 2003/0188453 A1 Oct. 9, 2003

(51) Int. Cl.[7] ..... A43B 13/28
(52) U.S. Cl. ..... 36/12; 36/17 R; 36/77 R
(58) Field of Search ..... 36/12, 17 R, 17 PW, 36/14, 4, 19 R, 78, 32 R, 77 R, 72 R

(56) References Cited

U.S. PATENT DOCUMENTS 1,229,077 A * 6/1917 Hedlund ..... 36/17 R
1,394,938 A * 10/1921 Rickey ..... 36/17 PW
1,643,678 A * 9/1927 Peer ..... 36/17 PW
1,907,143 A * 5/1933 Brown ..... 36/78
2,354,338 A * 7/1944 Stritter ..... 36/17 R
2,385,554 A * 9/1945 Stratton ..... 36/17 PW
2,394,216 A * 2/1946 Susswein ..... 36/77 R
2,437,030 A * 3/1948 Hoza ..... 36/14
2,438,016 A * 3/1948 McMurray ..... 36/17 R
2,445,665 A * 7/1948 Doherty ..... 36/14
2,958,965 A * 11/1960 Scala ..... 36/14
3,046,679 A * 7/1962 Maertens et al. ..... 36/17 R
3,107,443 A * 10/1963 Binder et al. ..... 36/17 R
4,326,313 A * 4/1982 Bensley ..... 36/17 PW
4,450,632 A * 5/1984 Bensley ..... 36/17 PW
5,628,127 A * 5/1997 Notzold ..... 36/14

* cited by examiner

*Primary Examiner*—Mickey Yu
*Assistant Examiner*—Greg Pickett
(74) *Attorney, Agent, or Firm*—Brooks Kushman P.C.

(57) ABSTRACT

A welted shoe includes a tab member joined with a bent portion of an upper at one end thereof, an insole superimposed on and engaged with the bent portion, and a welt member having a surrounding seat which is interposed between the bent portion and the tab member, a surrounding prop wall disposed to keep the profile of the upper, and an outwardly extending anchored end which is joined with the tab member so as to form a sub-assembly. An outsole is molded with the sub-assembly to underlie the sub-assembly, and extends uprightly to surround completely the welt member and to sealingly abut against the upper to provide a good waterproofing effect.

7 Claims, 7 Drawing Sheets

WELTED SHOE

BACKGROUND OF THE INVENTION

1. Field of the Invention

This invention relates to a welted shoe, more particularly to a welted shoe with an easily-assembled and waterproof structure.

2. Description of the Related Art

Referring to FIGS. 1 and 2, a conventional welted shoe disclosed in U.S. Pat. No. 6,192,605, is shown to include an upper 1 which is shaped over a last to impart a curve shape and which has a lower peripheral edge portion 2 that is bent underneath an insole 3 and that is joined thereto, and a molded midsole 4 which extends around the periphery of the upper 1 and which has a welt 5 and a midsole flange 6 integral with each other. The upper 1 and the insole 3 located therein are placed on the midsole 4 within the welt 5 so that the welt 5 engages the upper 1 around its periphery, and are joined together in a sub-assembly by stitching a plurality of stitches 7 through these components. The sub-assembly is placed on top of an outsole 8 having an outsole flange 9 which extends around the periphery of the upper 1. The outsole 8 is connected to the sub-assembly by stitching a plurality of stitches 10 through the flanges 6, 9.

It is inconvenient to stitch the insole 3, the upper and the midsole 4 together since the stitches 7 are made inside the upper 1. Moreover, the shoe does not have a good waterproofing effect because water can penetrate through a clearance between the welt 5 and the upper 1, along the stitch seam 7, and into the interior of the shoe.

SUMMARY OF THE INVENTION

The object of the present invention is to provide a welted shoe which is easily assembled and which has a good waterproofing effect.

According to this invention, the welted shoe includes an upper adapted to be lasted to form a surrounding wall and a surrounding bent portion. The surrounding wall surrounds a centerline and extends downwardly to terminate at a lower periphery. The surrounding bent portion extends from the lower periphery towards and in a plane normal to the centerline, and terminates at a surrounding joining edge. A plurality of tabs are angularly displaced from one another about the centerline. Each tab has an inner joined end which is joined with the surrounding joining edge such that the inner joined ends of the tabs and the surrounding joining edge cooperatively define an inner boundary line along the surrounding joining edge. Each tab further has an appendage portion which extends from the inner joined end away from the inner boundary line and outwardly of the lower periphery, and which terminates at an outer joined end.

An insole has a central portion, and a peripheral portion which surrounds the central portion and which is superimposed on the surrounding bent portion when the insole is engaged with the upper. A welt member is molded from a material more rigid than that of the upper, and includes a surrounding seat which extends towards the centerline to terminate at an insert peripheral edge. The insert peripheral edge is interposed between the surrounding bent portion and the appendage portion, and extends towards the inner boundary line so as to bring the inner boundary line inwardly to the vicinity of the central portion and to thereby stabilize the superimposition of the peripheral portion of the insole on the surrounding bent portion of the upper. A surrounding prop wall extends uprightly from the surrounding seat and distal from the insert peripheral edge, is configured to abut against and wrap around the lower periphery when the inner boundary line is brought to the vicinity of the central portion so as to help keep the profile of the upper, and terminates at a surrounding upper edge. A surrounding anchored end extends outwardly from the surrounding seat and outboard to the surrounding prop wall so as to be superimposed on the outer joined ends of the tabs, thereby forming an outer boundary line. A plurality of fasteners join the outer joined ends of the tabs with the surrounding anchored end so as to form a sub-assembly.

An outsole is molded with the sub-assembly to form an outsole body which underlies the tabs, the surrounding bent portion, and the central portion of the insole, which extends in longitudinal and transverse directions that are transverse to the centerline and outboard to the outer boundary line, and which terminates at a surrounding outer peripheral edge. A surrounding seal wall extends uprightly from the surrounding outer peripheral edge to surround the surrounding prop wall of the welt member and beyond the surrounding upper edge and to sealingly abut against the surrounding wall of the upper.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 6:
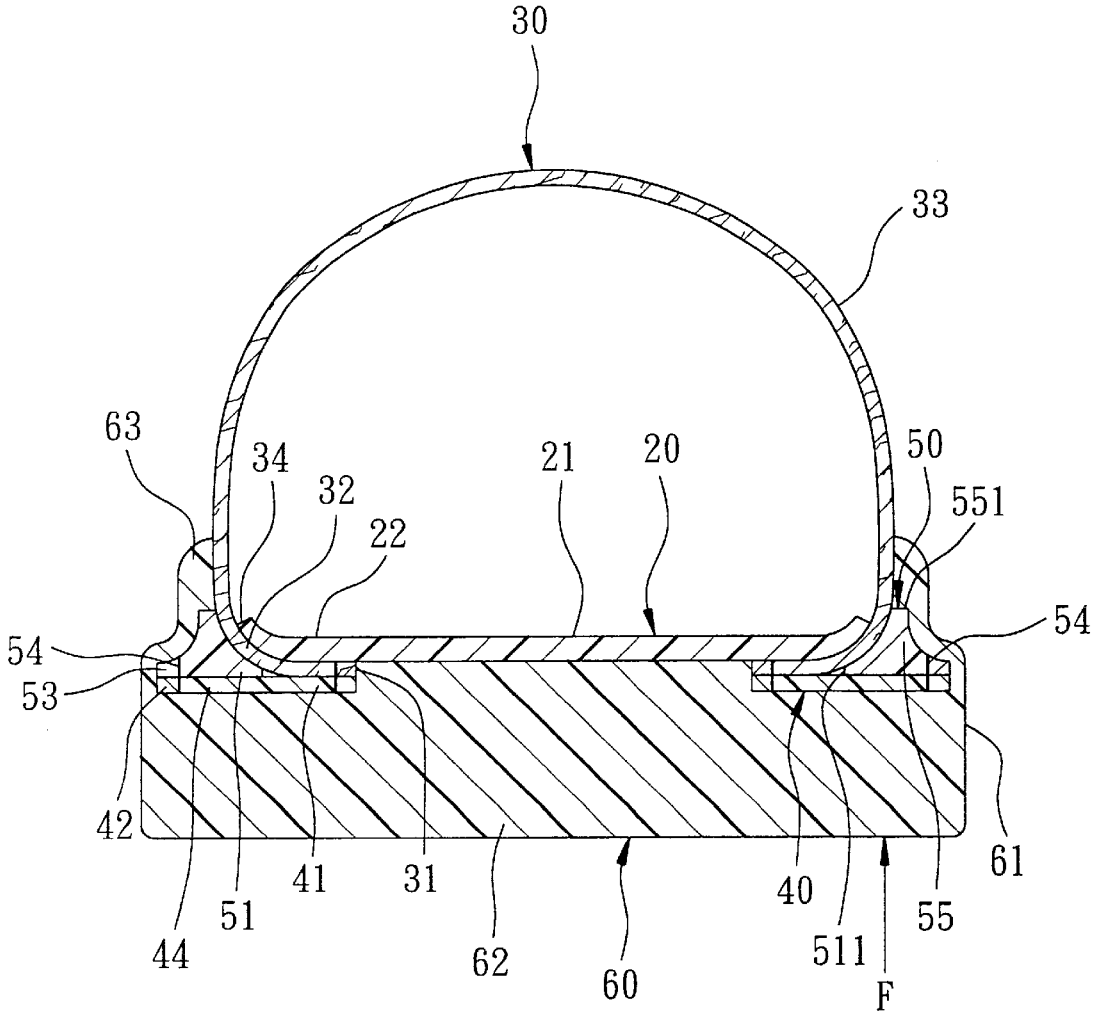
FIG. 6 is a cross-sectional view of the first preferred embodiment.

Referring to FIG. 6, the first preferred embodiment of the welted shoe according to the present invention is shown to comprise an upper 30, a tab member 40, an insole 20, a welt member 50, and an outsole 60.

Figure 1:
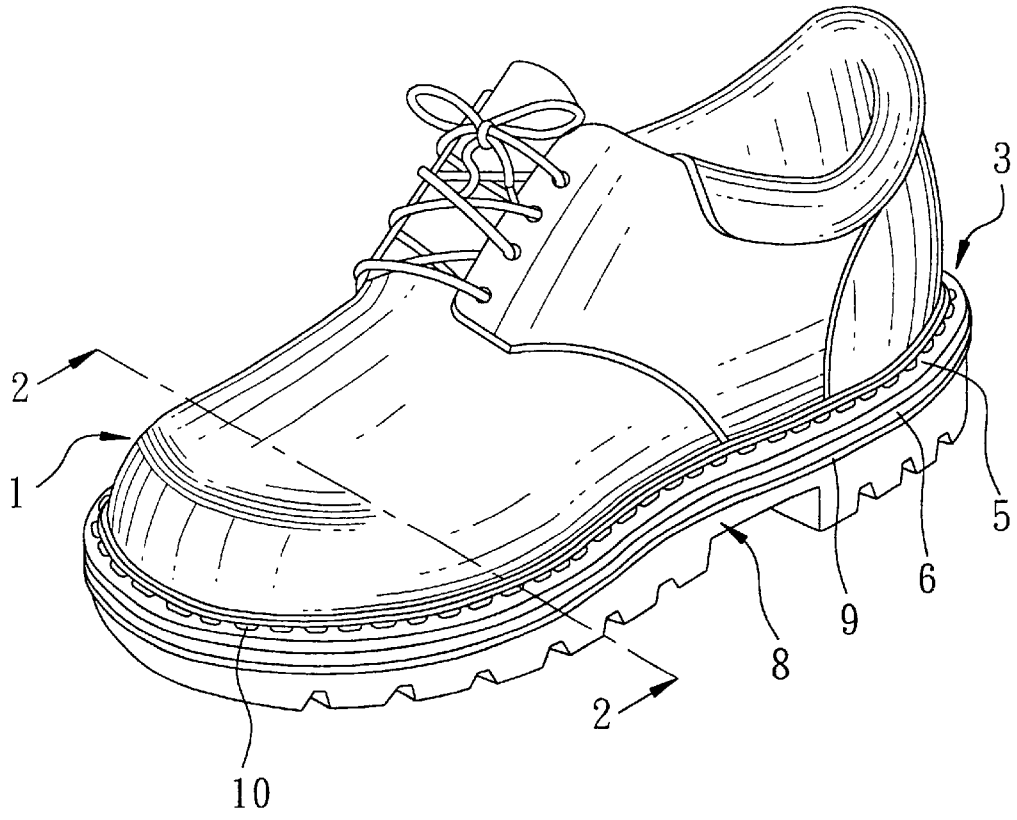
FIG. 1 PRIOR ART
FIG. 1 is a perspective view of a conventional welted shoe.
Figure 2:
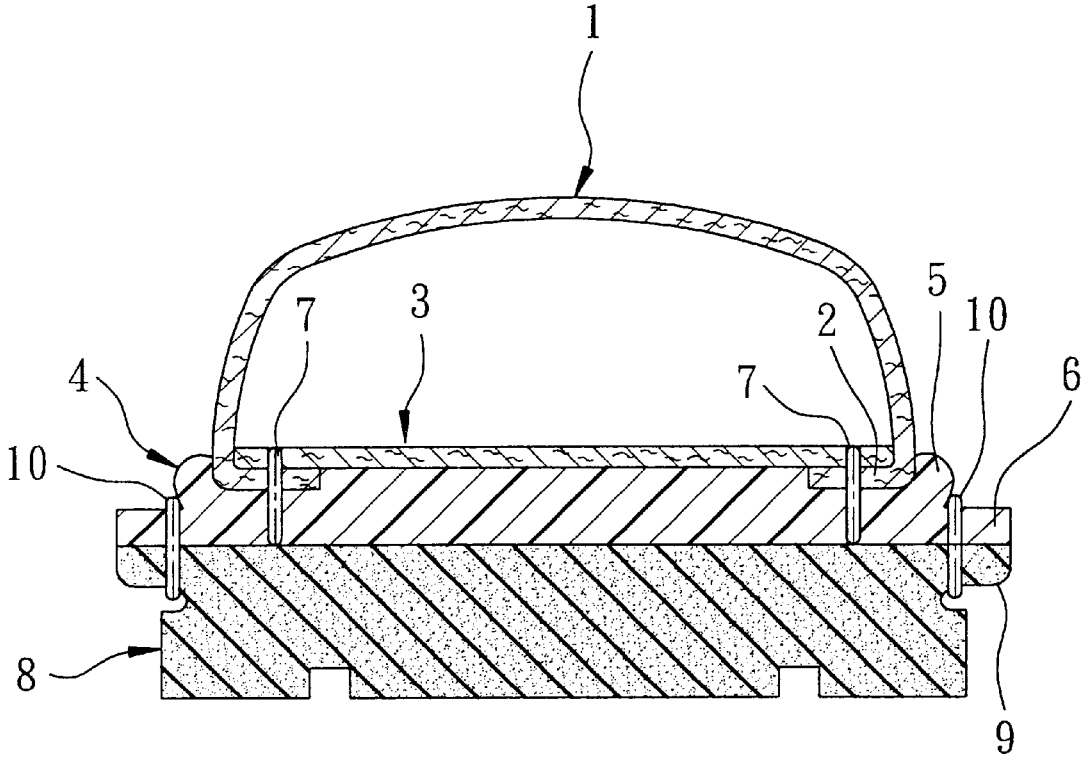
FIG. 2 PRIOR ART
FIG. 2 is an enlarged sectional view taken along line 2—2 of FIG. 1.
Figure 3:
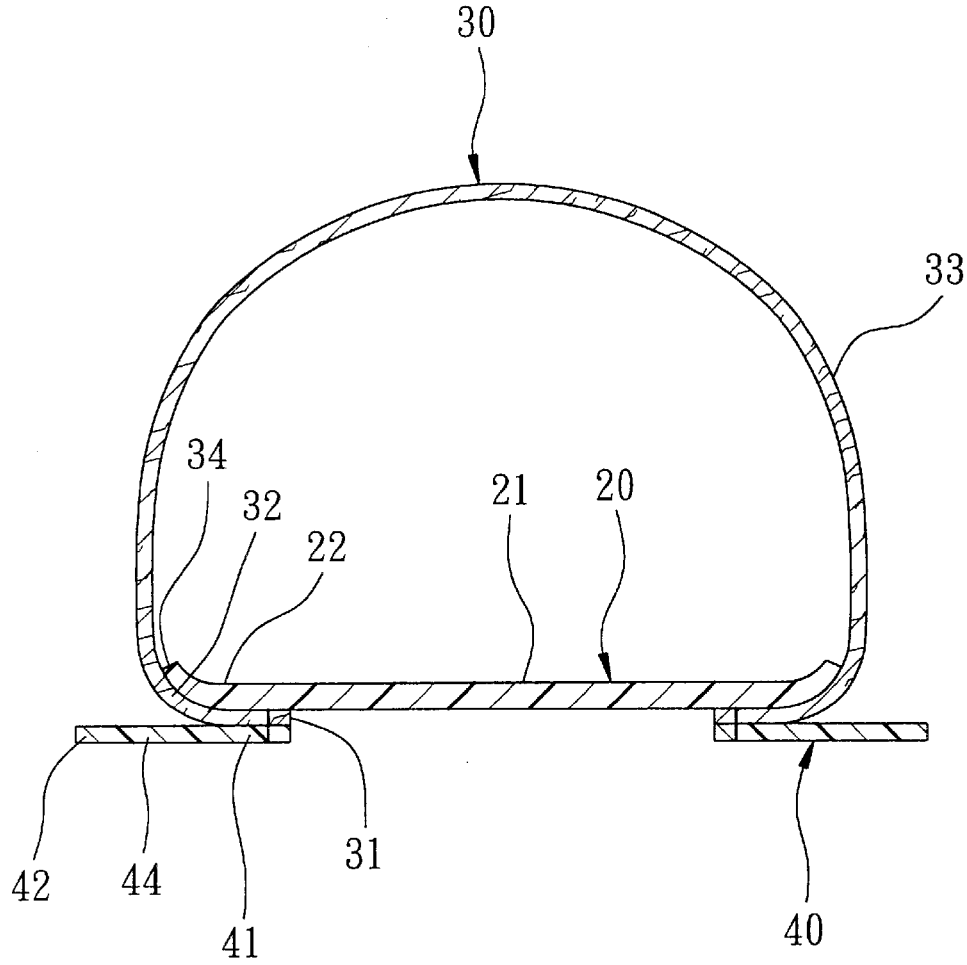
FIG. 3 is a cross-sectional view of a portion of a first preferred embodiment of a welted shoe according to this invention.
Figure 4:
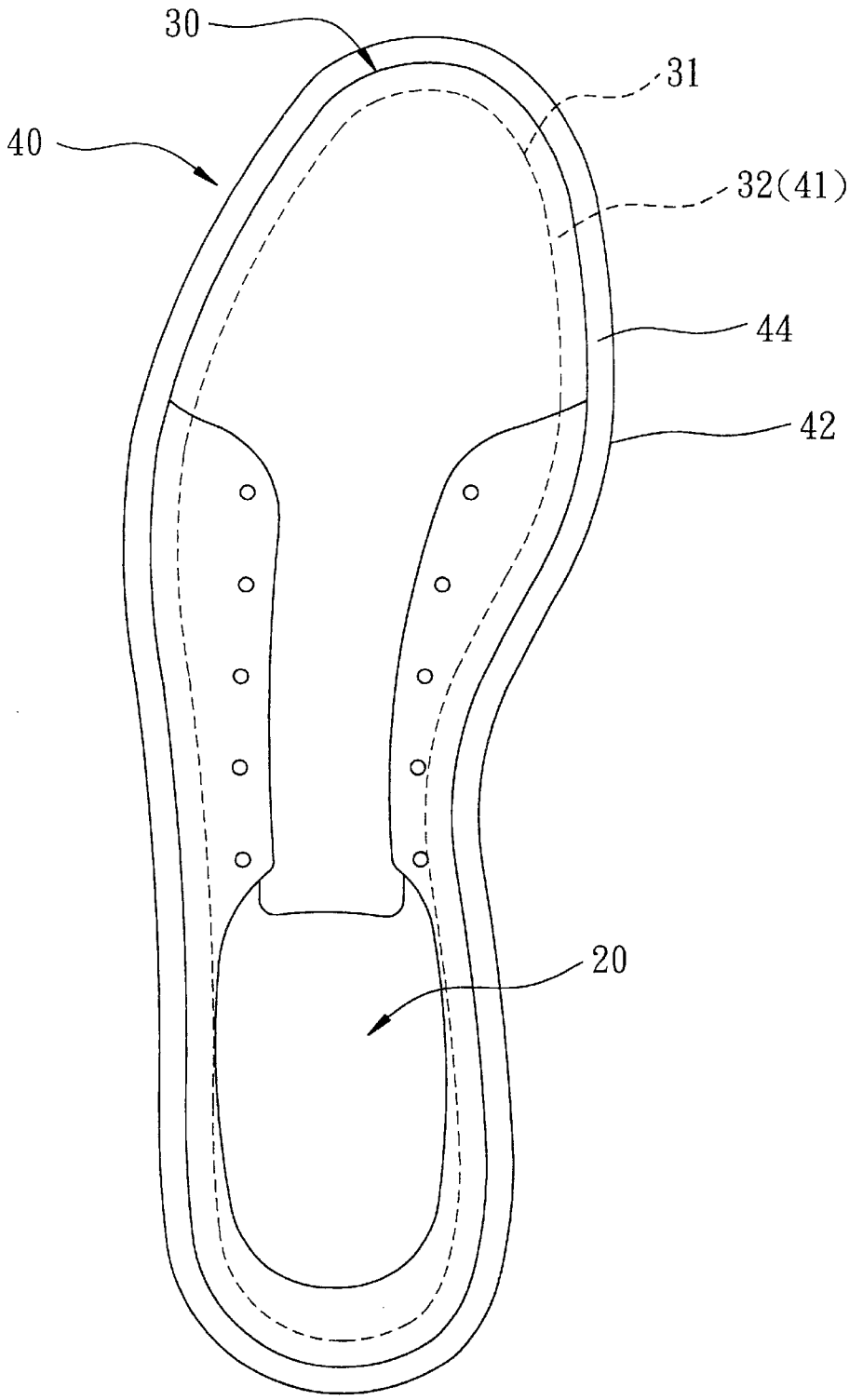
FIG. 4 is a top schematic view showing the first preferred embodiment in a semi-finished state.

As shown in FIGS. 3 and 4, the upper 30 is adapted to be lasted to form a surrounding wall 33 with a profile, and a surrounding bent portion 32. The surrounding wall 33 surrounds a centerline and extends downwardly to terminate at a lower periphery 34. The surrounding bent portion 32 extends from the lower periphery 34 towards and in a plane normal to the centerline, and terminates at a surrounding joining edge 31.

The tab member 40 has a single piece construction which is made from a fabric or leather material. Alternatively, the tab member 40 may be formed of a plurality of tabs angularly displaced from one another about the centerline. The tab member 40 has an inner joined end 41 which is disposed to be stitched with the surrounding joining edge 31 before the upper 30 is lasted so as to define an inner boundary line along the surrounding joining edge 31, and an appendage portion 44 which extends from the inner joined end 41 away from the inner boundary line and outwardly of the lower periphery 34 and which terminates at an outer joined end 42.

The insole 20 has a central portion 21 and a peripheral portion 22 which surrounds the central portion 21 and which is superimposed on the surrounding bent portion 32 of the upper 30 when the insole 20 is engaged with the upper 30 by adhesives.

Figure 5:
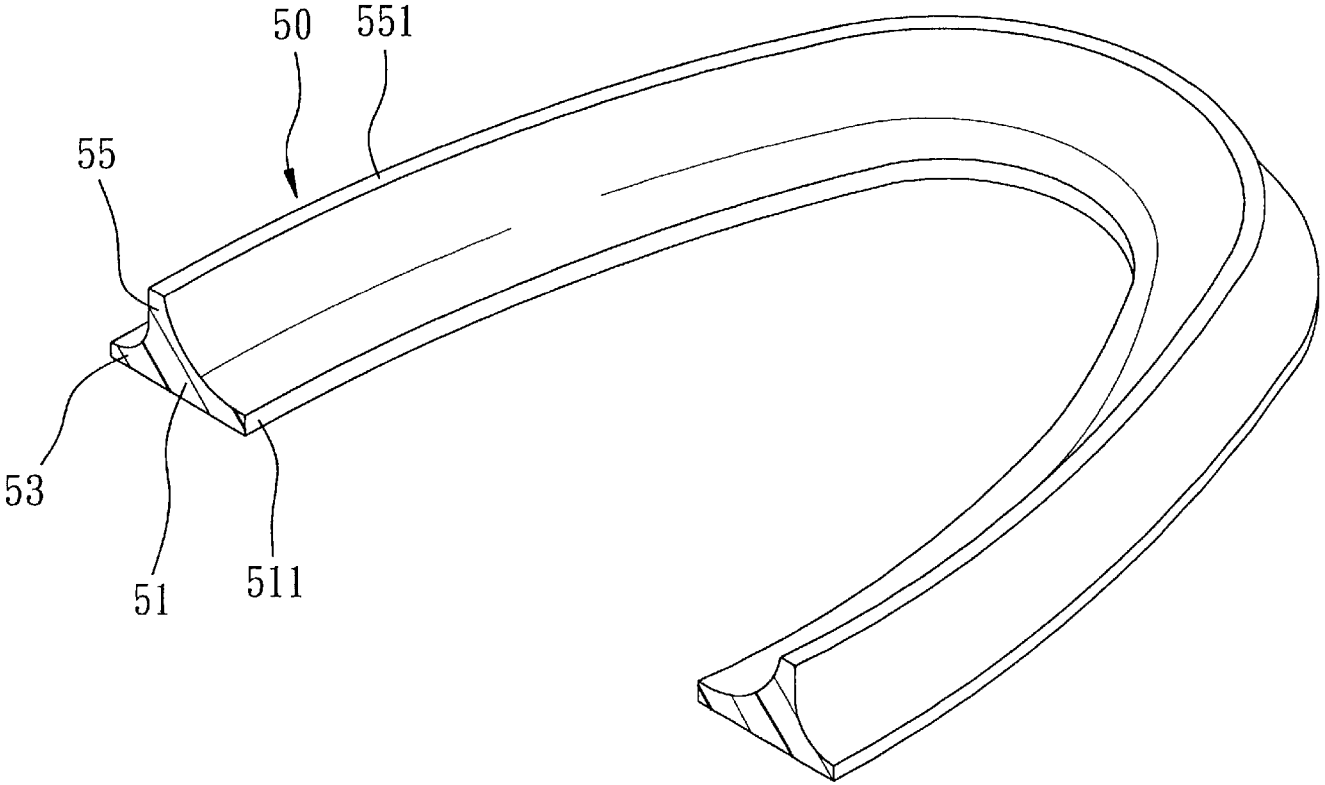
FIG. 5 is a fragmentary perspective view of a welt member of the first preferred embodiment.

With reference to FIGS. 5 and 6, the welt member 50 is molded from a material more rigid than that of the upper 30, such as rigid PVC material, and includes a surrounding seat 51 which extends towards the centerline to terminate at an insert peripheral edge 511. The insert peripheral edge 511 is interposed between the surrounding bent portion 32 and the appendage portion 44, and extends towards the inner boundary line so as to bring the inner boundary line inwardly to the vicinity of the central portion 21 of the insole 20, thereby stabilizing the superimposition of the peripheral portion 22 of the insole 20 on the surrounding bent portion 32 of the upper 30. A surrounding prop wall 55 extends uprightly from the surrounding seat 51 and distal from the insert peripheral edge 511, is configured to abut against and wrap around the lower periphery 34 when the inner boundary line is brought to the vicinity of the central portion 21 so as to help keep the profile of the surrounding wall 33 of the upper 30, and terminates at a surrounding upper edge 551. A surrounding anchored end 53 extends outwardly from the surrounding seat 51 and outboard to the surrounding prop wall 55 so as to be superimposed on the outer joined end 42 of the tab member 40, thereby forming an outer boundary line. A plurality of fasteners, such as stitches 54, extend through the outer joined end 42 of the tab member 40 and the surrounding anchored end 53 of the welt member 50 when the inner boundary line is brought to the vicinity of the central portion 21 along a line which is parallel to the centerline so as to form a sub-assembly (that is, the insole 20, the upper 30, the tab member 40, and the welt member 50 which have been assembled together).

The outsole 60 is formed from a molding material which is less rigid than that of the welt member 50, and is molded with the sub-assembly to form an outsole body 62 and a surrounding seal wall 63. The outsole body 62 underlies the tab member 40, the surrounding bent portion 32 of the upper 30, and the central portion 21 of the insole 20, extends in longitudinal and transverse directions which are transverse to the centerline and outboard to the outer boundary line of the surrounding anchored end 53, and terminates at a surrounding outer peripheral edge 61. The surrounding seal wall 63 extends uprightly from the surrounding outer peripheral edge 61 to surround the surrounding prop wall 55 of the welt member 50 and beyond the surrounding upper edge 551, and to sealingly abut against the surrounding wall 33 of the upper 30. In other words, the sub-assembly is disposed in a mold (not shown) for injection molding of the outsole 60 such that the outsole 60 is formed immediately below the sub-assembly, and such that the molding material penetrates into the sub-assembly to fill clearances present among these components of the structure and to embed the welt member 50 in the surrounding seal wall 63. As such, water can be prevented from entering into the welted shoe via the upper 30 and the welt member 50.

As illustrated, when the shoe according to this invention is subjected to a force (F), such as that shown in FIG. 6, the welt member 50 can prevent deformation of the profile of the upper 30. In addition, the surrounding seal wall 63 can protect the surrounding wall 33 of the upper 30 against wearing.

Further, as the stitches 31, 54 are made outside the upper 30, the sewing operations can be conducted in a convenient manner, without interference from the insole 20.

Figure 7:
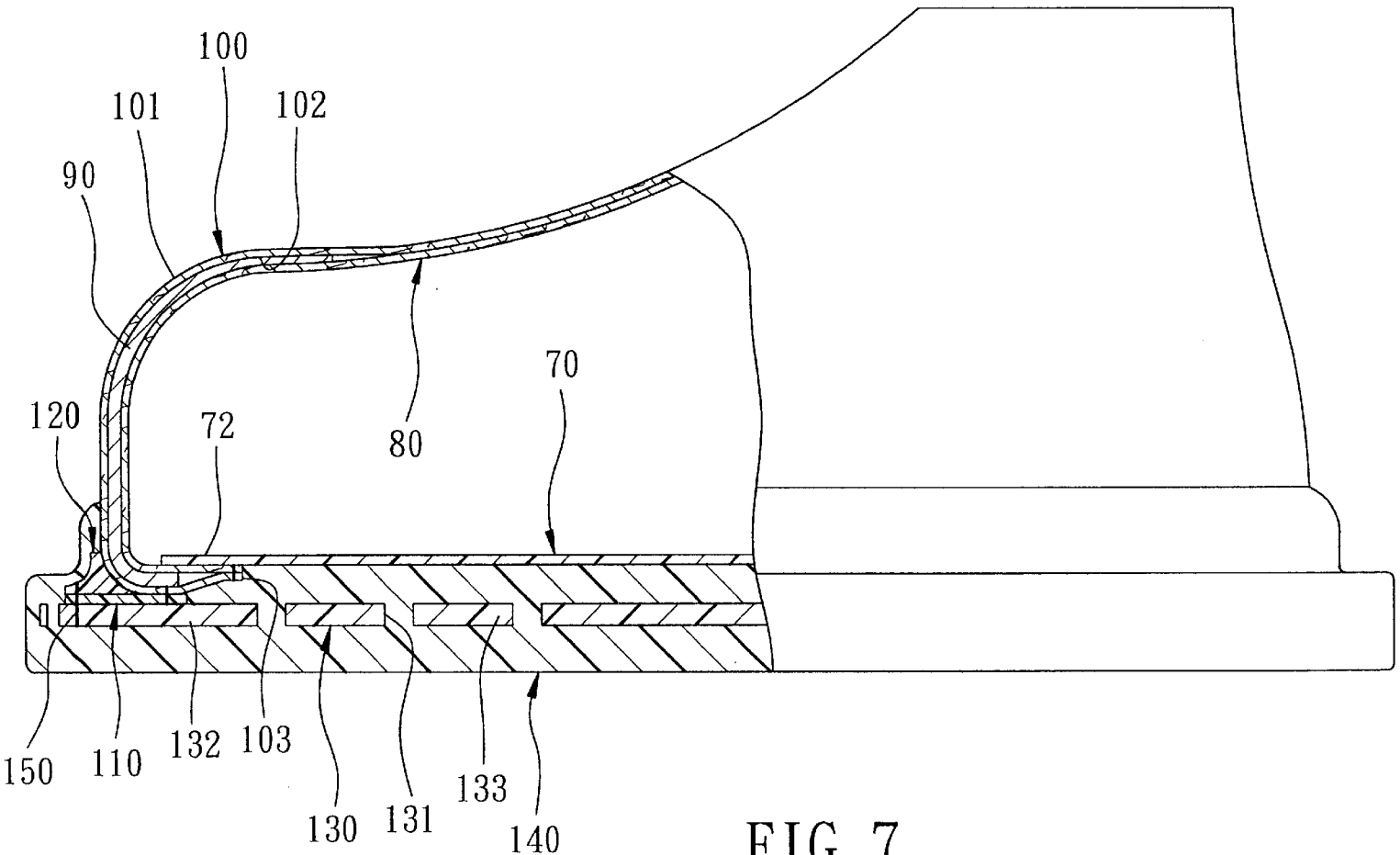
FIG. 7 is a partly sectional schematic view of a second preferred embodiment according to this invention.

FIG. 7 illustrates the second preferred embodiment of this invention. As shown, the welted shoe is a safety boot, in which an upper includes a toe cap 100 with outer and inner surfaces 101,102 which are opposite to each other and which are disposed distal from and proximate to the centerline, respectively. A lining layer 80 is disposed to be spaced apart from the inner surface 102 of the toe cap 100 by an accommodation space. The lining layer 80 is lasted to underlie a peripheral portion 72 of an insole 70, and is stitched with a surrounding joining edge 103 of the upper to form an internal boundary line. A shield member 90, which is made of a steel material, is disposed in the accommodation space, and extends toward the internal boundary line. A thin reinforcing member 130 is made of a material more rigid than that of the outsole 140, such as a rigid PVC material. The reinforcing member 130 includes an abutting portion 132 which abuts against a tab member 110 and which is stitched with the tab member 110 and a welt member 120 by stitches 150, and a perforated portion 133 which extends in the longitudinal and transverse directions, which is distal from the toe cap 100, and which is formed with a plurality of penetrating holes 131 that extend therethrough. As such, when the outsole 140 is molded with the sub-assembly, the molding material will flow into the penetrating holes 131.

As illustrated, since the sewing of the welt member 120 with the tab member 110 and the reinforcing member 130 is conducted outside the upper without passing through the shield member 90, the sewing operation is convenient and safe to conduct.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A welted shoe comprising:

an upper adapted to be lasted to form a surrounding wall with a profile, and a surrounding bent portion, said surrounding wall surrounding a centerline and extending downwardly to terminate at a lower periphery, said surrounding bent portion extending from said lower periphery towards and in a plane normal to the centerline, and terminating at a surrounding joining edge;

a plurality of tabs angularly displaced from one another about the centerline, each of said tabs having an inner joined end which is disposed to be joined with said surrounding joining edge, said inner joined ends of said tabs and said surrounding joining edge cooperatively defining an inner boundary line along said surrounding joining edge, each of said tabs further having an appendage portion which extends from said inner joined end away from said inner boundary line and outwardly of said lower periphery and which terminates at an outer joined end;

an insole having a central portion and a peripheral portion which surrounds said central portion and which is superimposed on said surrounding bent portion when said insole is engaged with said upper;

a welt member molded from a material more rigid than that of said upper, and including a surrounding seat extending towards the centerline and terminating at an insert peripheral edge, said insert peripheral edge being interposed between said surrounding bent portion and said appendage portion, and extending towards said inner boundary line so as to bring said inner boundary line inwardly to the vicinity of said central portion to thereby stabilize the superimposition of said peripheral portion of said insole on said surrounding bent portion of said upper, a surrounding prop wall which extends uprightly from said surrounding seat, which is distal from said insert peripheral edge, and which is configured to abut and wrap around said lower periphery when said inner boundary line is brought to the vicinity of said central portion so as to help keep the profile, and which terminates at a surrounding upper edge, and a surrounding anchored end extending outwardly from said surrounding seat and outboard to said surrounding prop wall so as to be superimposed on said outer joined ends of said tabs, thereby forming an outer boundary line;

a plurality of fasteners, each joining said outer joined end of each of said tabs with said surrounding anchored end when said inner boundary line is brought to the vicinity of said central portion so as to form a sub-assembly; and an outsole molded with said sub-assembly to form an outsole body which underlies said tabs, said surrounding bent portion, and said central portion of said insole, which extends in longitudinal and transverse directions that are transverse to the centerline and outboard to said outer boundary line, and which terminates at a surrounding outer peripheral edge, and a surrounding seal wall which extends uprightly from said surrounding outer peripheral edge to surround said surrounding prop wall of said welt member and beyond said surrounding upper edge and to sealingly abut against said surrounding wall of said upper.

2. The welted shoe of claim 1, wherein each of said fasteners is a stitch which extends through said outer joined end of each of said tabs and said surrounding anchored end along a line which is parallel to the centerline.

3. The welted shoe of claim 2, wherein said inner joined end of each of said tabs is stitched with said surrounding joining edge of said upper.

4. The welted shoe of claim 1, wherein said tabs are formed integrally with one another to form a single piece construction.

5. The welted shoe of claim 1, wherein said tabs are made from a fabric material.

6. The welted shoe of claim 1, wherein said upper includes a toe cap with outer and inner surfaces which are opposite to each other and which are disposed distal from and proximate to the centerline, respectively, said welted shoe further comprising a lining layer disposed to be spaced apart from said inner surface of said toe cap by an accommodation space, extending to underlie said peripheral portion of said insole, and joined with said surrounding joining edge to form an internal boundary line, and a shield member disposed in said accommodation space and extending toward said internal boundary line.

7. The welted shoe of claim 6, further comprising a reinforcing member made of a material more rigid than that of said outsole, said reinforcing member including an abutting portion which abuts against said tabs and which is joined with said tabs by said fasteners, and a perforated portion which extends in the longitudinal and transverse directions and which is distal from said toe cap, and which is formed with a plurality of penetrating holes extending therethrough such that when said outsole is molded with said sub-assembly, molding material which forms said outsole body will flow into said penetrating holes.

* * * * *